US005230775A

United States Patent [19]

Goodnow et al.

[11] Patent Number: 5,230,775

[45] Date of Patent: * Jul. 27, 1993

[54] BLADE EDGE LOADING CONTROL FOR DOCTORING APPARATUS

[75] Inventors: Ronald F. Goodnow, Leicester; Robert A. Reid, Charlton City, both of Mass.

[73] Assignee: Thermo Electron Web Systems, Inc., Auburn, Mass.

[ * ] Notice: The portion of the term of this patent subsequent to Nov. 19, 2008 has been disclaimed.

[21] Appl. No.: 708,342

[22] Filed: May 31, 1991

Related U.S. Application Data

[63] Continuation-in-part of Ser. No. 533,289, Jun. 5, 1990, Pat. No. 5,066,364.

[51] Int. Cl.[5] ..... B08B 1/02; D21G 3/00

[52] U.S. Cl. ..... 162/281; 162/272; 15/256.51; 15/256.63

[58] Field of Search ..... 162/199, 281, 282, 327, 162/272, 274; 15/256.5, 256.51, 256.53; 100/174; 118/652; 101/425; 355/299

[56] References Cited

U.S. PATENT DOCUMENTS

| | | | |
|---|---|---|---|
| 3,859,690 | 1/1975 | Brown | 15/256.51 |
| 4,114,228 | 9/1978 | Brown | 15/256.51 |
| 4,367,120 | 1/1983 | Hendrikz | 15/256.51 |
| 4,665,859 | 5/1987 | Dunlap | 15/256.51 |

FOREIGN PATENT DOCUMENTS

| | | | |
|---|---|---|---|
| 3623972 | 8/1987 | Fed. Rep. of Germany | 162/281 |

*Primary Examiner*—W. Gary Jones
*Assistant Examiner*—Brenda Lamb
*Attorney, Agent, or Firm*—Samuels, Gauthier & Stevens

[57] ABSTRACT

In a doctoring apparatus, blade edge loading is controlled along the sides of the surface being doctored.

11 Claims, 4 Drawing Sheets

BLADE EDGE LOADING CONTROL FOR DOCTORING APPARATUS

CROSS-REFERENCE TO RELATED APPLICATIONS

This application is a continuation-in-part of application Ser. No. 07/533,289 filed 06/05/90, now U.S. Pat. No. 5,066,364.

BACKGROUND OF THE INVENTION

This invention relates to doctoring apparatus, including those of the so-called "pull through" type where flexible elongated doctor blades are advanced longitudinally across the surfaces being doctored.

U.S. Pat. No. 4,691,406, the disclosure of which is herein incorporated by reference in its entirety, discloses a pull through doctoring apparatus. The doctor blade has a length greater than the width of the surface being doctored. A blade holder applies an intermediate portion of the blade to the surface being doctored. The blade is movable longitudinally through the blade holder, and has continuing portions which extend in opposite directions beyond the ends of the holder to pay off and take up reels. Clamps act on the continuing blade portions and are adjustable between closed settings preventing relative movement between them and the blade, and open settings permitting such relative movement. A drive reciprocates the blade holder. The clamps are opened and closed in timed sequence with reciprocation of the blade holder to achieve longitudinal shifting of the blade in a selected direction across the doctored surface, from one to the other of the reels. This type of blade transfer system maximizes efficiency by eliminating lost production time normally associated with the changing of conventional "cut to length" blades.

SUMMARY OF THE INVENTION

A primary objective of the present invention is to further maximize the efficiency of pull through blade transfer systems by safeguarding the blades against abrupt and potentially damaging contact with the doctored surface along the sides thereof, particularly at the location where the blade is being fed onto the doctored surface. To this end, means are provided for relieving blade loading forces at the edges of the doctored surface, and for contouring the loading forces to achieve a gradual feathering of the blade onto the doctored surface.

Certain of the blade profiling capabilities of the present invention are also applicable to blade holders supporting more conventional "cut to length" blades.

These and other objects and advantages will hereinafter be described in greater detail by reference to the accompanying drawings, wherein:

DETAILED DESCRIPTION OF ILLUSTRATED EMBODIMENT

Figure 1:
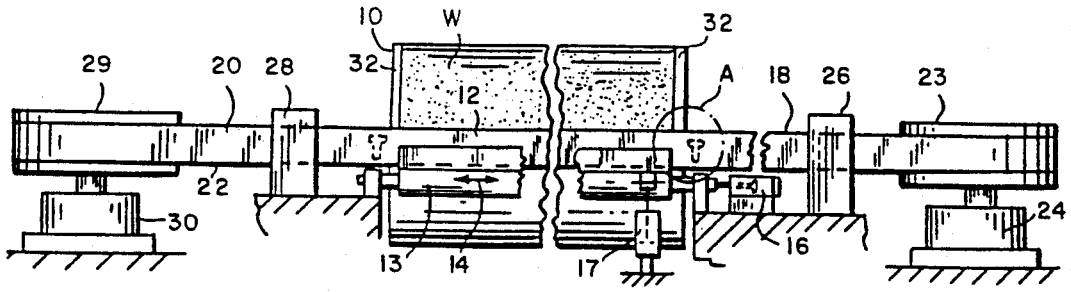
FIG. 1 is a schematic illustration of a pull through doctor blade transfer system in accordance with the present invention.

Referring initially to FIG. 1, a pull through doctor blade transfer system is shown doctoring a rotating cylinder 10. A doctor blade holder 12 is mounted on a doctor back 13 and is positioned adjacent to the cylinder 10. The doctor back is adapted to be reciprocated to and from in the direction of arrow 14 by any convenient means, one example being a double acting piston-cylinder unit 16. The doctor back is rotatably adjusted by means of another piston-cylinder unit 17 to urge the holder 12 towards the cylinder 10, thus applying the working edge 18 of an elongated flexible doctor blade 20 to the roll surface. The base of piston-cylinder unit 17 is articulately supported to accommodate reciprocation of the doctor back, which normally is no more than a few centimeters in each direction. The doctor blade has a bottom edge 22 which is parallel to the working edge 18 and which is supported in the holder 12.

The doctor blade 20 is adapted to be wound into a coil. A cartridge 23 containing a fresh coil is mounted on a payoff reel 24. The leading blade end is then threaded through a first clamp 26, the blade holder 12, a second clamp 28, and is then connected to an empty cartridge 29 mounted on a take up reel 30.

During the doctoring operation, the doctor back 13 and the holder 12 are oscillated by the piston-cylinder unit 16, and the clamps 26,28 are employed in timed sequence with this oscillation to shift the blade longitudinally across the cylinder surface, with blade stock being gradually paid off from cartridge 23 at reel 24 and taken up on cartridge 29 at reel 30. A more detailed description of this procedure is provided in the previously referenced U.S. Pat. No. 4,691,406.

When the trailing end of one blade length leaves the cartridge 23 at the pay off reel 24, that cartridge is replaced by another cartridge containing a fresh coil. The leading end of the fresh coil is then advanced to a position directly adjacent to the preceding trailing end, and the two ends are detachably interconnected. This having been accomplished, the doctoring operation is momentarily interrupted while the reels 24,30 are speeded up with the clamps 26,28 open to rapidly traverse the interconnected ends across the cylinder 10. Then, the doctoring operation is continued, and the blade ends are disconnected to allow the cartridge 29 containing the spent coil to be replaced by an empty cartridge to which the fresh leading end is then connected.

In order to maximize the operating efficiency of the blade pull through system, the blade edge 18 must be of uninterrupted quality when it comes into contact with the process web W being doctored off of the surface of cylinder 10. This necessitates that the blade must be fed onto the cylinder surface with great care. A gradual feathering is desirable with particular concern for the very edge of the surface to be doctored. Undesired abrupt contact could result in the formation of a nick or wear mark which ultimately enters into the process web, thus resulting in a poor quality web or web disconnection. Consequently any damage of this nature may have to be advanced entirely across the machine width, necessitating an interruption of the process for some time period which detracts from the benefits of the entire system.

Areas 32 outside of the width of the process web W require special care when doctoring and have a tendency to be less lubricated by the lack of contact with the web. These areas commonly have a higher degree of heat because no thermal transfer occurs from contact with the web. Lack of lubrication and additional heat tend to cause break down of the working edge of the doctor blade, which can greatly affect the traverse rate at which the coil of blade stock can be fed without problems.

A coil which has to be traversed at higher than optimum speed rates results in premature coil changes. Each premature change in turn results in wasted blade stock due to more frequent blade regrinds and also results in substantially more machine down time, all of which detracts from the expected payback of a pull through blade system.

Figure 4:
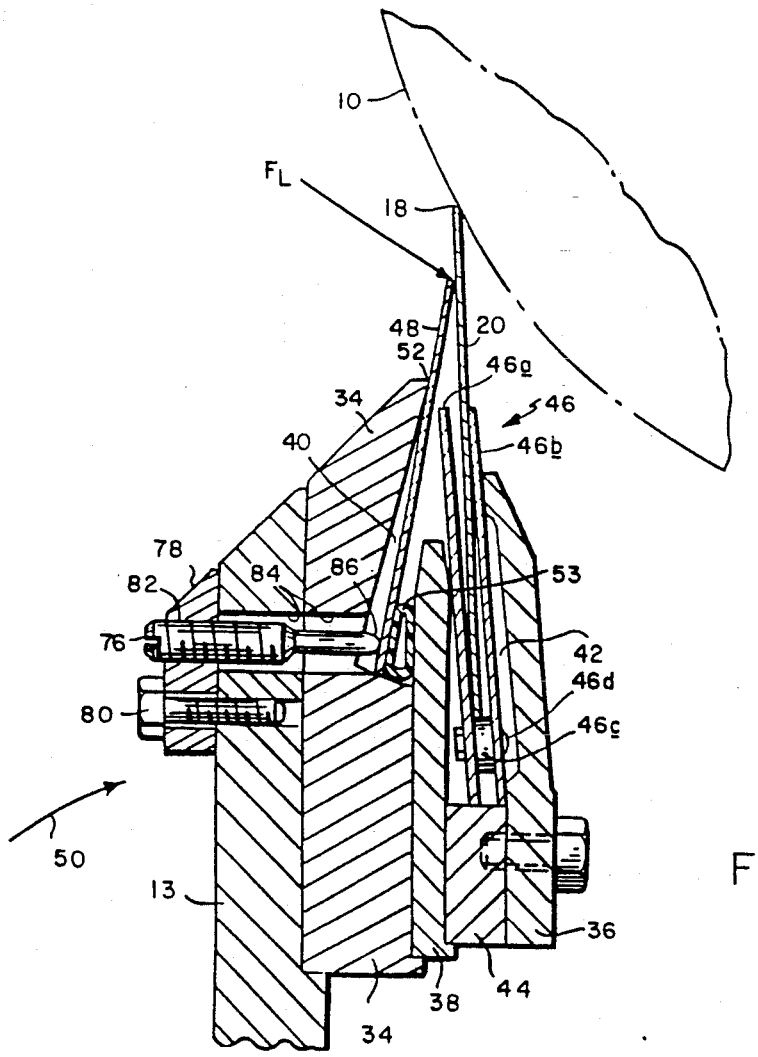
FIG. 4 is an enlarged partial cross sectional view taken through the doctor blade holder along line 4—4 of FIG. 2 and depicting the set screw arrangement for achieving blade feathering at the edges of the cylinder surface.
Figure 3:
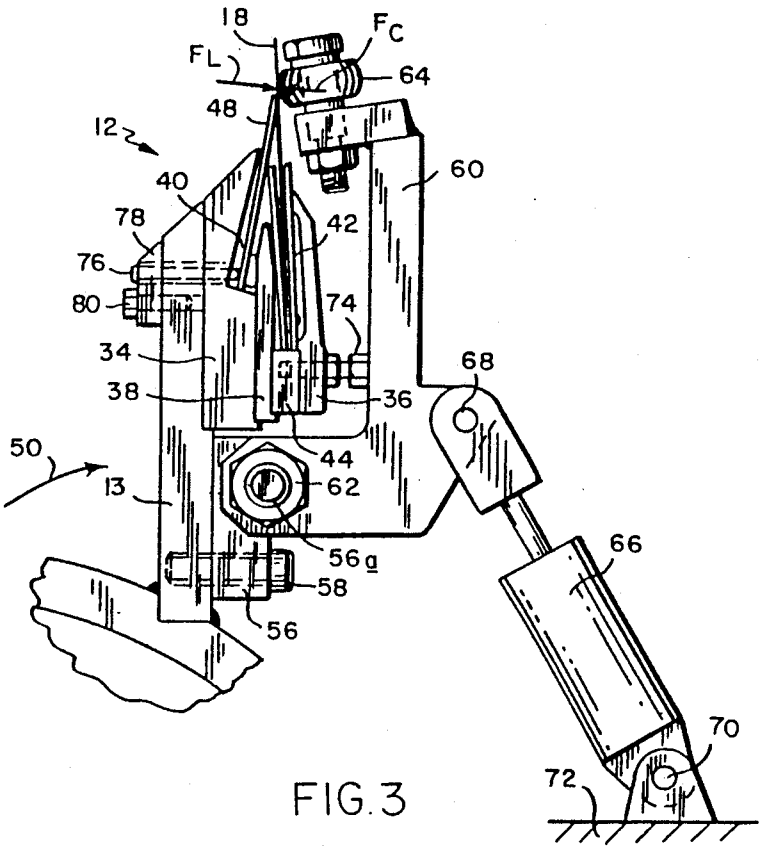
FIG. 3 is a sectional view through the blade stock taken on line 3—3 of FIG. 2.
Figure 2:
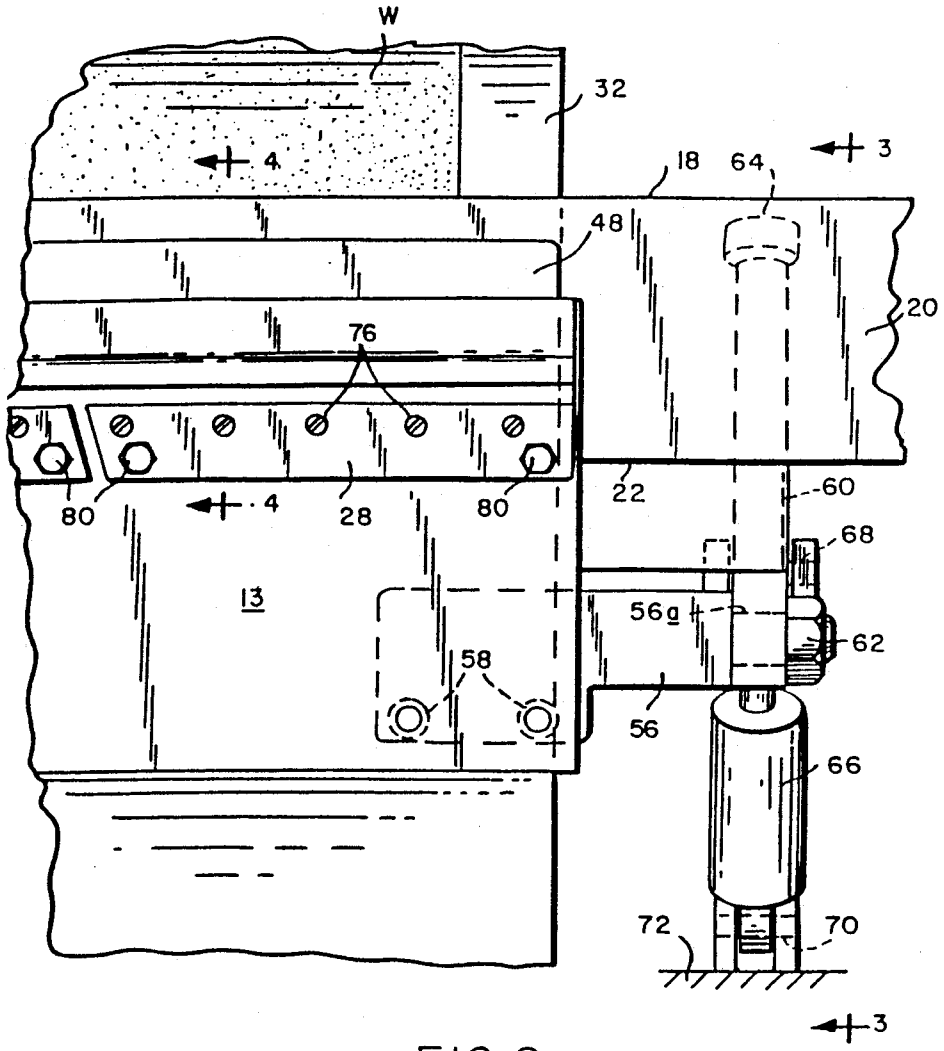
FIG. 2 is an enlarged view of that portion of the apparatus enclosed by the reference circle A in FIG. 1.

With the foregoing in mind, and with reference additionally to FIGS. 2–4, it will be seen that the blade holder 12 incorporates certain standard components, including top and bottom plates 34,36 with a central member 38 interposed therebetween to subdivide the holder into a back up blade chamber 40 and a doctor blade chamber 42. Spacers 44 separate the bottom plate 36 from the central member 38.

A blade carrier 46 consisting of carrier plates **46*a*,46*b* separated by spacers 46*c* and interconnected by pins 46*d* is located in the doctor blade chamber 42. The carrier 46 is of conventional construction, and is fixed against movement in the direction of blade length by an appropriate key, stop or the like (not shown). The doctor blade 20 is guided longitudinally through the carrier 46, with its bottom edge 22 being supported on the spacers 46*c*. As the blade is successively reground, the spacers 46*c* and pins 46*d* are gradually raised, thereby insuring that the working edge 18** of the blade always contacts the cylinder surface at the desired location.

A back up blade 48 is located in the back up blade chamber 40. When the doctor back 13 is rotated in the direction of arrow 50 by the loading cylinder 17, the top plate 34 of the holder contacts the back up blade 48 as at 52, causing the back up blade to bear against the top surface of the doctor blade 20 with a loading force $F_L$. This in turn results in the blade working edge 18 being applied to the cylinder surface 10 with the appropriate force required to achieve doctoring. During doctoring, the back up blade 48 will pivot about the line of force application 52, and its bottom portion will bear against a liquid filled profiling tube 53.

According to one aspect of the present invention, the loading force $F_L$ is relieved at the edge areas 32. To this end, a support bracket 56 is secured to the doctor back 13 as at 58. The end **56*a* of the bracket 56 is cylindrical and serves as a pivot for a loading arm 60. A nut 62 is threaded onto the end 56*a*** to hold the arm in place.

Arm 60 carries a roller 64 arranged to bear against the bottom surface of the doctor blade 20 at a location outside the width of the cylinder 10. A piston-cylinder unit 66 is pivotally connected at one end as at 68 to the arm 60 and at the opposite end as at 70 to a support structure 72. Connection 70 again allows for sufficient articulation to accommodate the slight reciprocation of the doctor back. The piston-cylinder unit 66 pivots the arm 60 about pivot **56*a*, thus urging the roller 64 against the bottom surface of the doctor blade 20 with a force $F_c$ counteracting and relieving the loading force $F_L$ being applied at the top blade surface by the back up blade 48. By thus relieving the loading force by a counteracting force applied to the underside of the doctor blade, overloading along the edge areas 32 of the cylinder is avoided. In point of fact, the counteracting force $F_c$ can be controlled to an extent such that the blade either passes over or just lightly engages the areas 32**.

An adjustable stop 74 is interposed between blade holder plate 36 and the loading arm 60. Once the desired level of counteracting force has been achieved, the stop 74 can be set, making it possible thereafter to maintain repeatability.

Gradual feathering of the blade onto the surface of the cylinder 10 is achieved by properly adjusting set screws 76 arranged at intervals along the side portions of the doctor structure. Screw support bars 78 are secured by means of bolts 80 to the doctor structure back 13. The bars have a series of threaded holes 82 therein communicating with aligned holes 84 in the doctor back 13 and holder plate 34. The set screws 76 are threaded through the holes 82 and extend through the aligned holes 84 into the back up blade chamber 40 where they contact the back up blade 48 as at 86 to urge the back up blade against the profiling tube 53.

During the initial fine tuning of the installation to achieve a gradual feathering of the blade 20 onto the surface of the cylinder 10, the set screws 76 are adjusted with the bars 78 bolted in place. Thereafter, should it become necessary to relieve the forces exerted by the set screws, e.g., when changing the back up blade 48, one need only disconnect the bars 78 from the doctor structure 13 by removing the bolts 80. The set screws will remain threaded into the holes 82 in the bars 78, and upon remounting the bars, the set screws will automatically be returned to their original positions, thus achieving repeatability of the feathering settings without any need to painstakingly readjust the set screws.

Figure 5:
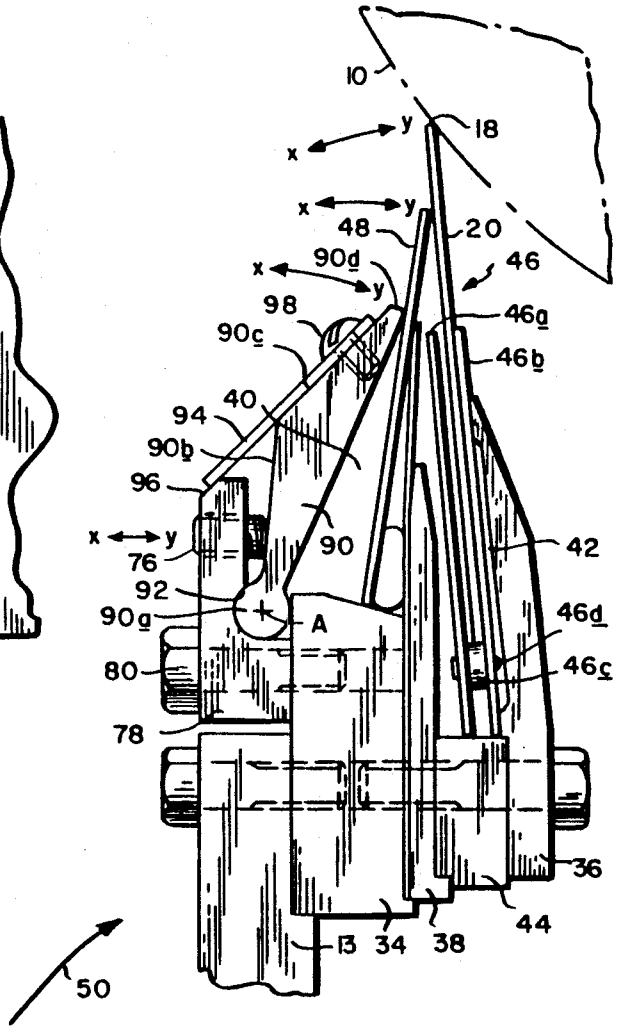
FIG. 5 is a view similar to FIG. 4 showing an alternative embodiment of a blade holder in accordance with the present invention.
Figure 6:
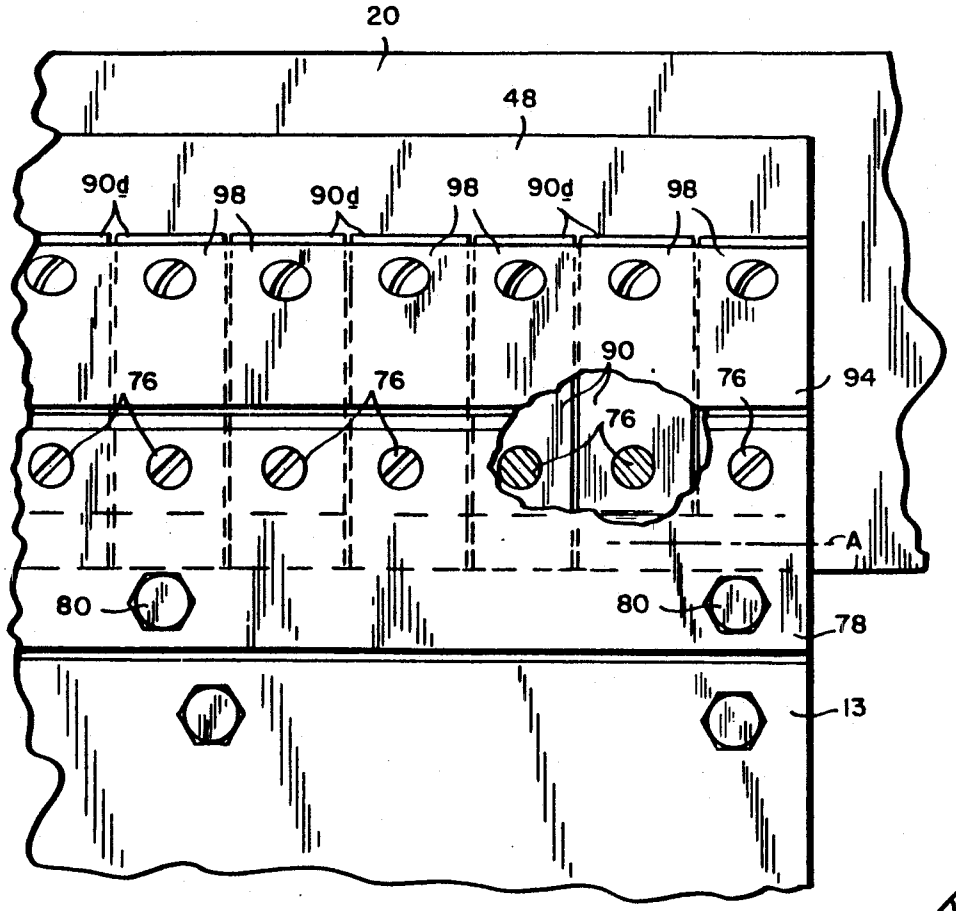
FIG. 6 is a front elevational view of the blade holder shown in FIG. 5.

An alternative embodiment of an arrangement for varying blade pressure along the length of the doctor blade is shown in FIGS. 5 and 6. Like reference numerals have been employed to designate those components which are identical or equivalent to those included in the previously described embodiment illustrated in FIGS. 1–4. The width of the bottom holder plate 34 has been reduced to make room for a plurality of mutually adjacent fingers 90. Each finger has a cylindrical base **90*a*, a back surface 90*b*, an inclined top surface 90*c*, and a nose 90*d*. The cylindrical bases 90*a* are received in a partially cylindrical recess 92 in the support bar 78 and are independently pivotable about a common axis "A". The support bar 78 is removably secured to the doctor back 13 by bolts 80. Set screws 76 are again threaded through the support bar to provide adjustable stops bearing against the back surfaces 90*b* of the fingers 90. A flexible cover plate 94 overlies both the fingers 90 and an inclined top edge 96 of the support bar 78. The plate 94 is in slidable contact with inclined surface 96 and is secured to each of the fingers 90 by screws 98**.

When the doctor back 13 is rotated in the direction 50, the finger noses 90*d* will bear against the back up blade 48, causing the working edge 18 of the doctor blade 20 to be applied to the surface of cylinder 10, and resulting in a reactionary force being applied by the rear finger surfaces 90*b* against the set screws 82. By adjusting the set screws 82, the doctor blade pressure can thus be varied along the length of the doctor blade. The flexibility of the cover plate 94 and its slidable contact with the inclined top edge 96 of the support bar serves to accommodate independent pivotal movement of the fingers 90. Once properly adjusted, the set screws 76 can remain undisturbed. Should it become necessary to remove the back up blade 48, one need only remove the support bar 78, bringing with it the fingers 90 and the cover plate 94. The entire assembly can then be reinstalled with repeatability of the blade pressure profile being assured due to the fact that the adjustment of the set screws 76 has remained undisturbed.

Figure 8:
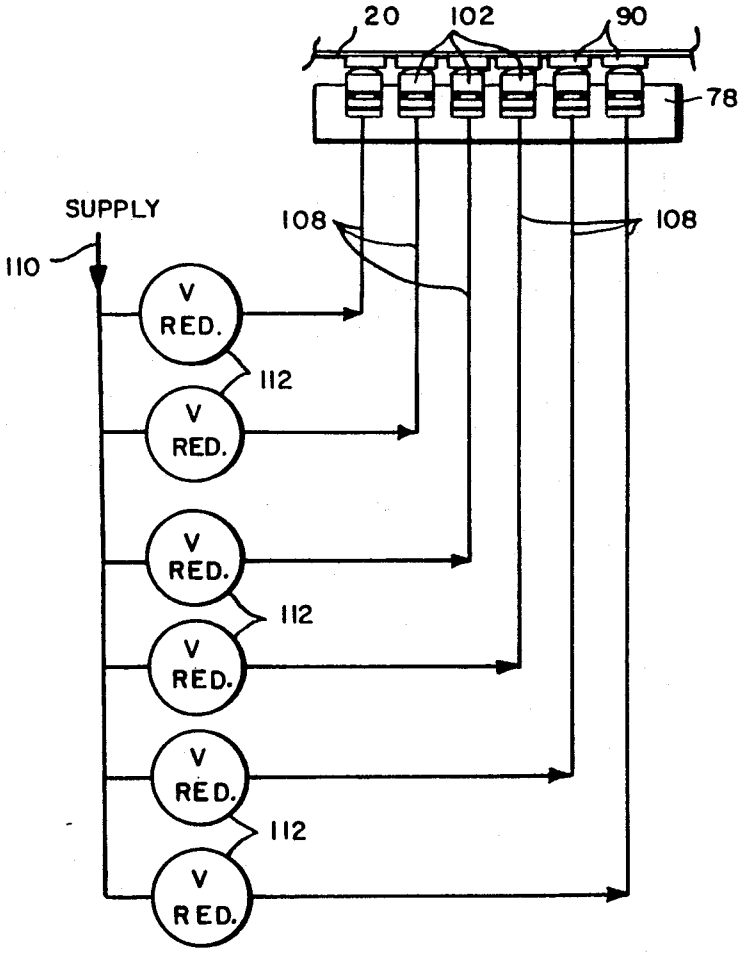
FIG. 8 is a schematic illustration of the hydraulic system employed in conjunction with the embodiment showing in FIG. 7.
Figure 7:
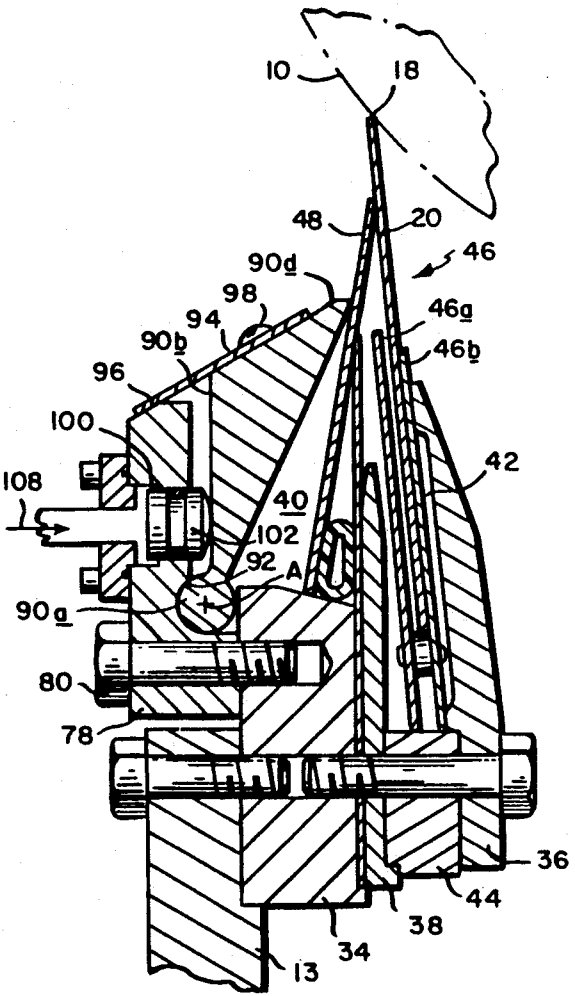
FIG. 7 is a view similar to FIG. 5 showing still another embodiment of a blade holder in accordance with the present invention.

Still another embodiment of the invention is disclosed in FIGS. 7 and 8. Here, the support bar 78 has been modified to define a plurality of hydraulic chambers 10 containing pistons 102. The noses of the pistons serve as stops contacting the rear surfaces 90*b* of the fingers 90. A cover plate 104 seals off the rear ends of the chambers 100. The cover plate has apertures 106 communicating with the chambers. Hydraulic supply conduits 108 are connected to the apertures 106. Each conduit 108 is connected to a main hydraulic supply line 110. Adjustable pressure regulators 112 are interposed in the conduits 108 between the main hydraulic supply line 110 and each piston/cylinder assembly.

During the set up procedure, each regulator 112 is preset to achieve a proper positioning of the respective piston 102. Thereafter, when access to the back up blade 48 is required, the main hydraulic supply pressure is removed before dismantling the support bar 78 and its associated fingers 90, cover plate 94, etc. The reverse procedure can then be followed, again with repeatability of the blade pressure profile being assured due to the previously adjusted settings of the pressure regulators 112. This embodiment has the further advantage of being remotely adjustable. Thus, an operator can "fine tune" blade pressure profiles while the doctoring operation is under way by simply adjusting one or more of the pressure regulators 112.

In light of the foregoing, it will now be appreciated by those skilled in the art that the present invention makes it possible to achieve proper blade loading and orientation at the critical areas along the sides of the surface being doctored. Although the invention has been described with reference to blade loading and feathering at one side of the cylinder, it will be understood that a mirror image of the same components will normally be employed at the opposite side of the cylinder, thereby accomodating reverse feeding of blade stock from a cartridge on reel 30 to a cartridge on reel 24.

It should further be appreciated by those skilled in the art that the blade pressure profiling arrangements disclosed in FIGS. 2 and 4, 5 and 6, and 7 and 8 also can be employed in more conventional doctor blade installations where single blades are not "pulled through" the holder, but rather remain in place until replaced by a fresh blade. Moreover, such devices may be employed not only at the respective ends of the doctor blade, i.e., along the edges of the surfaces being doctored, but also at other areas along the blade length. In point of fact, where appropriate, the entire length of the blade can be profiled by using a series of such devices.

We claim:

1. Apparatus for doctoring a moving surface, comprising:

a blade holder having multiple integrally interconnected components arranged to define separate first and second chambers;

a doctor blade supported by said blade holder in said first chamber, said doctor blade having a working edge extending across the width of said moving surface;

a back up blade supported by said blade holder in said second chamber, said back blade being arranged to bear against and to extend along the length of said doctor blade;

means for urging said blade holder in a direction causing said back up blade to be pressed against said doctor blade to thereby exert a loading force urging the working edge of said doctor blade against said moving surface;

at least one support member carried on said blade holder and having adjustable contact means engageable with said back up blade to vary said loading force along the length of said working edge; and means for detachably securing said support member to said blade holder in a manner permitting disengagement and reengagement of said contact means from and with said back up blade without disturbing either the adjustment of said contact means or the interconnection of the components of said blade holder.

2. The apparatus of claim 1 wherein said adjustable contact means comprises a plurality of set screws threaded through said support member and bearing against said back up blade.

3. The apparatus of claim 1 wherein said blade holder includes a force exerting component arranged to engage and press said back up blade against said doctor blade.

4. The apparatus of claim 3 wherein said force exerting component is arranged along the length of said back up blade.

5. The apparatus of claim 3 wherein said force exerting component comprises a plurality of pivotal finger members.

6. The apparatus of claim 5 wherein said adjustable contact means comprises a plurality of set screws threaded through said support member and bearing against a respective one of said finger members.

7. The apparatus of claim 5 wherein said support member defines a plurality of chambers with pistons received in said chambers, and with means for pressurizing said chambers to urge said pistons against said finger members.

8. The apparatus of either claims 5, 6 or 7 wherein said finger members are carried by said support member.

9. The apparatus of claim 8 wherein said finger members are interconnected by a cover plate, said cover plate being arranged to overlie said finger members and said removable support member.

10. The apparatus of claim 9 wherein said cover plate is in slidable contact with said support member.

11. Apparatus for doctoring a moving surface, said apparatus comprising:

a blade holder having multiple integrally interconnected components arranged to define separate first and second chambers;

a doctor blade having a pressure surface and a working edge, said doctor blade being supported by said blade holder in said first chamber at a location spanning the width of said moving surface;

a back up blade supported by said blade holder in said second chamber, said back up blade being inclined in relation to said doctor blade and having an edge bearing against said pressure surface;

a support member carried on said blade holder;

stop members carried by said support member and bearing against said back up blade at locations spaced along the length thereof;

means for urging said blade holder in one direction to load the working edge of said doctor blade against said moving surface, with a resulting reactionary force being exerted by said back-up blade against said stop members;

contact means for adjusting the positions of said stop members in relation to said support member to vary said reactionary force along the length of said back up blade; and means for detachably securing said support member to said blade holder in a manner permitting disengagement and reengagement of said stop members from sand with said back up blade without disturbing either the adjustment of said contact means or the interconnection of the components of said blade holder.

* * * * *